US007036959B2

(12) United States Patent
Chiu

(10) Patent No.: US 7,036,959 B2
(45) Date of Patent: May 2, 2006

(54) LED LAMPSHADE FOR ADVERTISEMENT BRAND AND DECORATION

(76) Inventor: Cho-Ten Chiu, 235 Chung-Ho Box 8-24, Taipei (TW)

( * ) Notice: Subject to any disclaimer, the term of this patent is extended or adjusted under 35 U.S.C. 154(b) by 162 days.

(21) Appl. No.: 10/789,790

(22) Filed: Feb. 26, 2004

(65) Prior Publication Data

US 2005/0190566 A1 Sep. 1, 2005

(51) Int. Cl.
*F21V 1/06* (2006.01)

(52) U.S. Cl. ..... 362/352; 362/351

(58) Field of Classification Search ..... 362/352, 362/351, 361, 362, 257, 310, 396, 249, 806, 362/353, 311, 317
See application file for complete search history.

(56) References Cited

U.S. PATENT DOCUMENTS 2,269,182 A * 1/1942 Claspy et al. ..... 362/361
4,858,088 A * 8/1989 Agabekov ..... 362/249
5,287,259 A * 2/1994 Lautzenheiser ..... 362/341

* cited by examiner

*Primary Examiner*—John Anthony Ward
*Assistant Examiner*—Bao Q. Truong

(57) ABSTRACT

An LED lampshade for advertisement brand and decoration comprises a deformable cover having two tenons at two ends; the cover being originally a flat shape; after assembly, the cover having a U shape; and a seat having two trenches positioned corresponding to the two tenons of the cover. The seat has a groove for locating an LED lamp. Two lower ends of the seat have the tenons, respectively. An upper side of each tenon has a stopper; and a transparent portion is formed on the cover. The groove is formed between the two trenches. Each trench has a corresponding elastomer aside the trench; each elastomer has a corresponding seat notch for receiving the elastomer as the elastomer is pressed downwards. In assembly, the two tenons of the cover are inserted into the trenches of the seat so that the cover is formed on the seat.

1 Claim, 3 Drawing Sheets

LED LAMPSHADE FOR ADVERTISEMENT BRAND AND DECORATION

FIELD OF THE INVENTION

The present invention relates to lampshades, and particularly to a LED lampshade for advertisement brand and decoration, in that the covers of the LED lampshades are improved to be a longer sheet before assembly so that it is convenient in transfer and storage.

BACKGROUND OF THE INVENTION

LED lamps are now widely used in many fields, such as advertisements, decorations, vehicles as illuminators due to the advantages of the longer lifetime, low power consumption, and low pollution, etc. of LEDs. As shown in FIG. 1, a prior art LED lampshade is illustrated. However this prior art design encounters some disadvantages in manufacturing and transfer.

The cover of the lampshade is formed with a fixed structure. Thereby it is convenient in transfer or storage. Although soft materials, such as PP, are used, the LED lampshade is hollow, in transfer, the cover will deform, even break.

Furthermore, the length of the lampshade cannot be overlong. In general, the length must be below 5 meters. If the length is over 5 meters, the transfer and storage work will become difficult. Thereby the quality control of the lampshade will also become difficult.

SUMMARY OF THE INVENTION

Accordingly, the primary object of the present invention is to provide an LED lampshade for advertisement brand and decoration comprises a deformable cover having two tenons at two ends; the cover being originally a flat shape; after assembly, the cover having a U shape; and a seat having two trenches which is positioned corresponding to the two tenons of the cover; wherein the seat has a groove for locating an LED lamp. Two lower ends of the seat have the tenons, respectively. An upper side of each tenon has a stopper; and a transparent portion is formed on the cover. The groove is formed between the two trenches. Each trench has a corresponding elastomer aside the trench; each elastomer has a corresponding seat notch for receiving the elastomer as the elastomer is pressed downwards. In assembly, the two tenons of the cover are inserted into the trenches of the seat so that the cover is formed on the seat.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
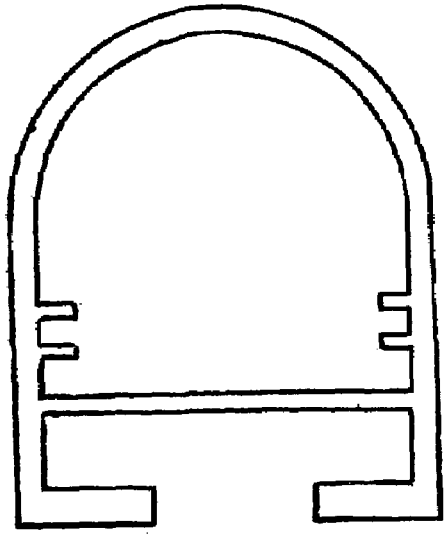
FIG. 1 is a plane schematic view about a prior art LED lampshade.
Figure 3:
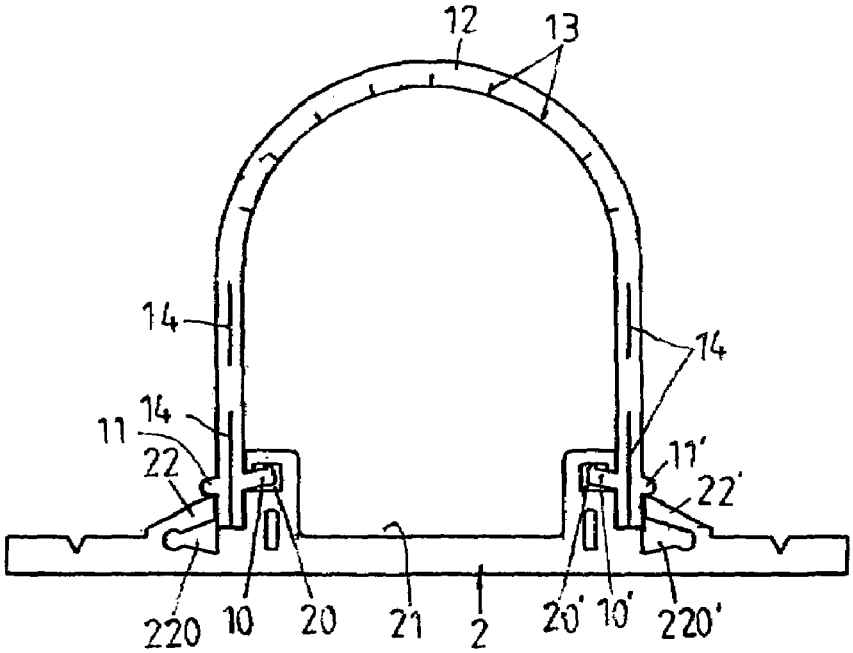
FIG. 3 is an assembled schematic view of the present invention.
Figure 2:
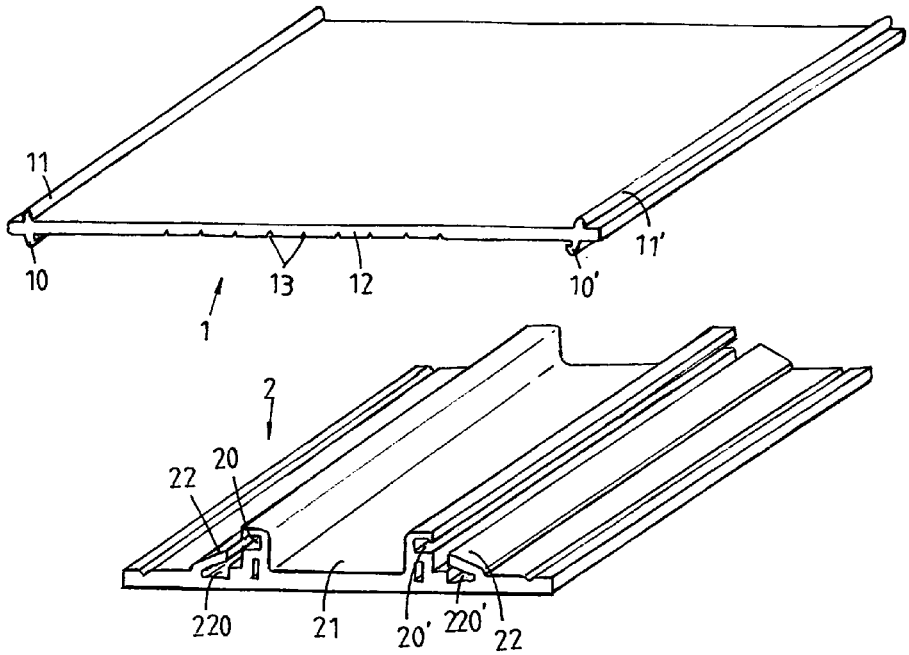
FIG. 2 is an exploded view of the present invention.

With reference to FIGS. 2 and 3, the exploded view and assemble plane view of the present invention are illustrated. The LED lampshade for advertisement brand and decoration of the present invention includes a cover 1 and a seat 2. The cover 1 is deformable, as shown in FIG. 1. Before assembly to the seat, the cover 1 has a flat shape and is deformable. Two lower ends of the cover 1 has tenons 10, 10', respectively. Each tenon is formed as a hook. An upper side of the tenon 10, 10' has a stopper 11, 11'. A transparent portion 12 is formed on the cover 1. A lower side of the transparent portion 12 is formed with a plurality of V shape notches 13 so that the cover is deformable easily.

Figure 4:
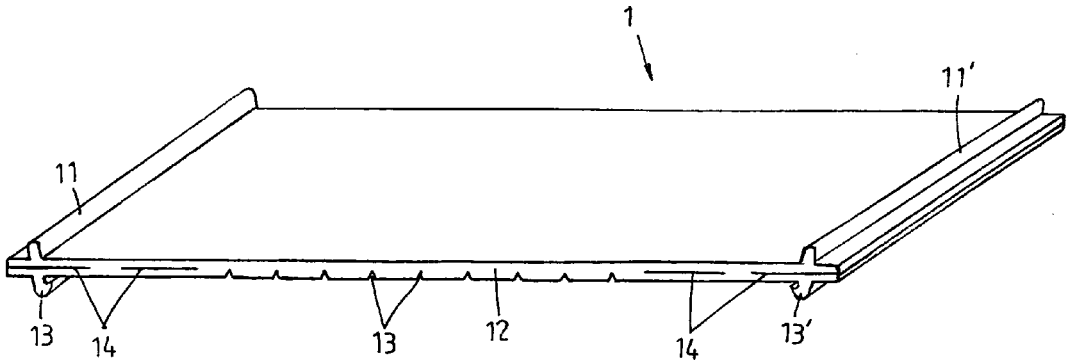
FIG. 4 is a schematic view showing that aluminum pieces are embedded into the cover according to the present invention.

Referring to FIG. 4, a plurality of aluminum sheets 14 are embedded into the cover 1 to enhance the structural strength of the cover.

The seat 2 has a flat bottom. Two opposite and symmetrical trenches 20, 20' are installed on the seat 2. A groove 21 is formed between the two trenches 20, 20'. Each trench 20, 20' has a corresponding elastomer 22, 22' aside the trench 20, 20'. Each elastomer 22, 22' has a corresponding seat notch 220, 220' below the elastomer 22, 22' and is located in the seat 2. The tenons 11, 11' are fixed by one of the trenches 20, 20' and a corresponding elastomers 22, 22'. In assembly, the cover 1 is bent as a U shape lampshade for being assembled on the seat 2.

Figure 5:
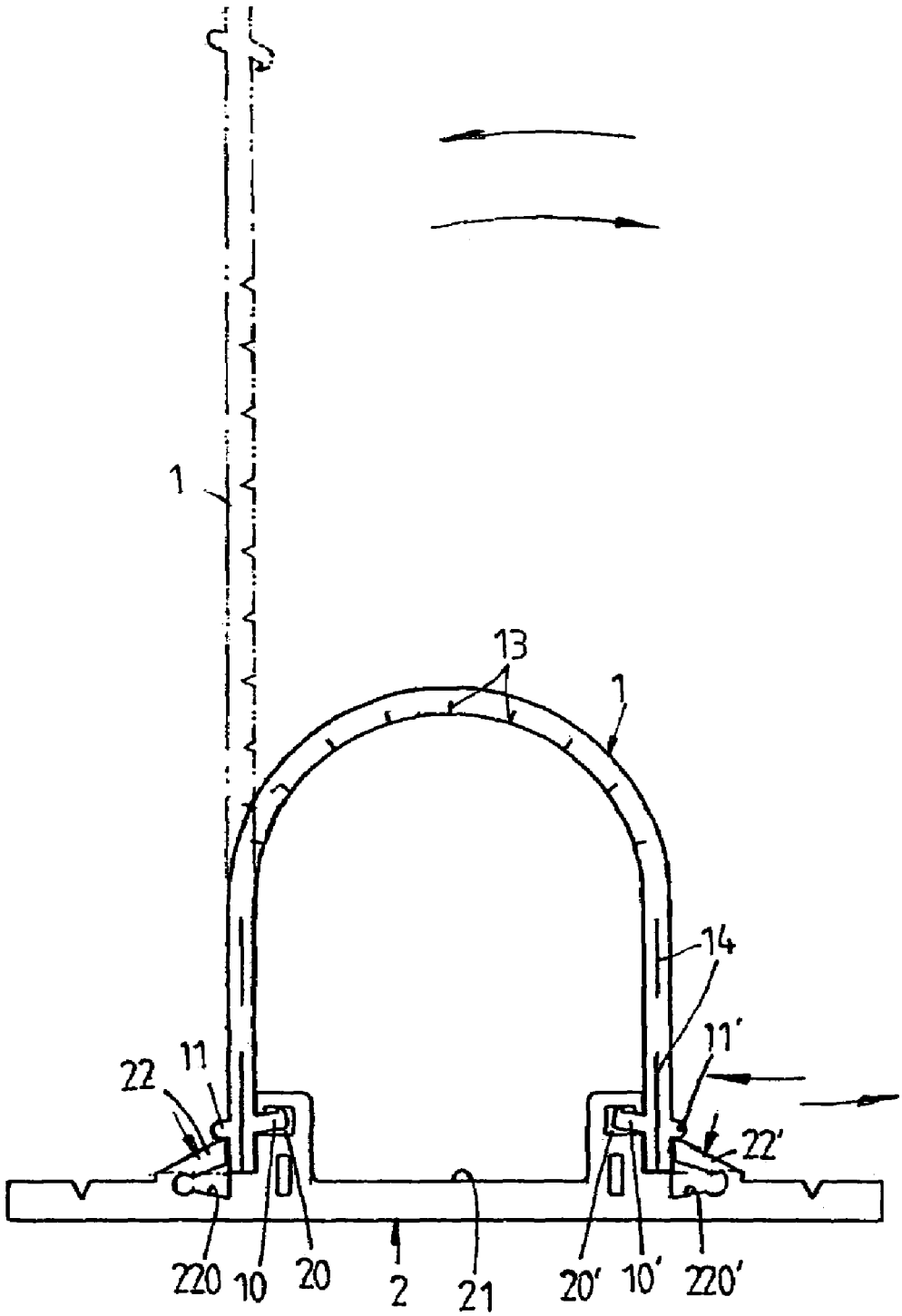
FIG. 5 is a schematic view about the assembly and detach of the present invention.

Referring to FIG. 5, the assembly of the present invention is illustrated. In FIG. 5, at first, a long cover 1 is first cut to a desired length. Then two sides of the cover 1 are installed with the tenons. LED lamp is installed to the groove 21 of the seat 2. Then the cover 1 is bent to have a U shape and then is located above the seat 2 so that each tenon is located with a corresponding trench 20, 20' and a corresponding elastomer 22, 22'. If it is desired to detach the cover 1. It is only necessary to press the two elastomers 22, 22' downwards so that the elastomers 22, 22' are embedded into the corresponding seat notches 220, 220'. Thus the cover 1 can be taken out. Thereby the detachment work is complete.

Advantages of the present invention will be described herein. Since originally, the covers and seats are flats, they are convenient in transfer in the manufacturing process. Further, originally, the covers are made by cutting a long sheet, before cutting, the long sheet can be wound as a winding so as to be transferred conveniently. Moreover, the assembly of the present invention is easy. It is only necessary to insert the tenons into the trenches of the seat. Moreover, the cover is a one-piece object so that no connection work is necessary, but in the prior art the cover is formed by connecting two pieces.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An LED lampshade for advertisement brand and decoration comprising:

a deformable cover having two tenons at two ends; the cover being originally a flat shape; after assembly, the cover having a U shape; and a seat having two trenches which is positioned corresponding to the two tenons of the cover; wherein the seat has a groove;

wherein in assembly, the two tenons of the cover are inserted into the trenches of the seat so that the cover is formed on the seat; and wherein the seat has a flat bottom; the two trenches are installed on the seat; the groove is formed between the two trenches; each trench has a corresponding elastomer aside the trench; each elastomer has a corresponding seat notch below the elastomer and is located in the seat for receiving the elastomer as the elastomer is pressed downwards.

* * * * *